US009167863B2

(12) United States Patent
Settele et al.

(10) Patent No.: US 9,167,863 B2
(45) Date of Patent: Oct. 27, 2015

(54) SHOE, FOR EXAMPLE SHOE WITH A HIGH UPPER

(75) Inventors: Andreas Settele, Munich (DE); Hendrik Broedenfeld, Reichertshausen-Pischelsdorf (DE); Iztok Nemc, Trzic (SI)

(73) Assignee: Lowa Sportschuhe GmbH, Jetzendorf (DE)

( * ) Notice: Subject to any disclaimer, the term of this patent is extended or adjusted under 35 U.S.C. 154(b) by 1117 days.

(21) Appl. No.: 12/999,500

(22) PCT Filed: Jun. 18, 2009

(86) PCT No.: PCT/EP2009/057611

§ 371 (c)(1),
(2), (4) Date: Apr. 12, 2011

(87) PCT Pub. No.: WO2009/153316

PCT Pub. Date: Dec. 23, 2009

(65) Prior Publication Data

US 2011/0296712 A1 Dec. 8, 2011

(30) Foreign Application Priority Data

Jun. 18, 2008 (DE) ..... 10 2008 028 882

(51) Int. Cl.
*A43C 7/00* (2006.01)
*A43C 1/00* (2006.01)
(Continued)

(52) U.S. Cl.
CPC . *A43B 5/04* (2013.01); *A43B 5/002* (2013.01); *A43B 5/0401* (2013.01); *A43B 23/26* (2013.01); *A43C 7/00* (2013.01); *A43C 11/008* (2013.01); *A43C 11/20* (2013.01); *Y10T 24/3724* (2015.01)

(58) Field of Classification Search
CPC ..... A43B 5/04; A43B 5/0401; A43B 5/002; A43B 23/26; Y10T 24/3716; Y10T 24/3724; Y10T 24/3742; Y10T 24/3703; Y10T 24/3694; A43C 7/00; A43C 7/005; A43C 7/08; A43C 3/00; A43C 1/04; A43C 11/008; A43C 11/14; A43C 11/20; A43C 11/22; A43C 11/24
USPC ..... 24/101 R, 114.12, 114.9, 712, 712.1, 24/712.2, 712.6, 712.9, 713.2, 713.4, 24/713.6; 36/50.1, 54, 100, 101, 112, 132, 36/136; 2/244–246
See application file for complete search history.

(56) References Cited

U.S. PATENT DOCUMENTS 1,472,519 A 10/1923 Gingrich
1,506,614 A 8/1924 Cook
(Continued)

FOREIGN PATENT DOCUMENTS

DE 809294 7/1949
DE 1813929 6/1960
(Continued)

*Primary Examiner* — Alissa L Hoey
*Assistant Examiner* — Jameson Collier
(74) *Attorney, Agent, or Firm* — Rothwell, Figg, Ernst & Manbeck, P.C.

(57) ABSTRACT

A shoe that includes an upper portion with an inlet, a tongue extending substantially along the inlet, and a tongue retaining unit associated with the tongue, which at least hinders the tongue from slipping sideways when the shoe is laced. According to the invention, at least one retaining element is associated with at least one of the edges of the inlet, wherein the retaining element may be brought into form-fitting retaining engagement with the tongue retaining unit, such that it exerts a pulling force on the tongue retaining unit at least when the tongue shifts from a desired position in a direction away from the associated edge when the shoe is laced.

21 Claims, 3 Drawing Sheets

(51) Int. Cl.

| | |
|---|---|
| ***A43B 23/00*** | (2006.01) |
| ***A43B 5/04*** | (2006.01) |
| ***A43C 11/00*** | (2006.01) |
| ***A43B 5/00*** | (2006.01) |
| ***A43B 23/26*** | (2006.01) |
| ***A43C 11/20*** | (2006.01) |

(56) References Cited

U.S. PATENT DOCUMENTS

| | | | | |
|---|---|---|---|---|
| 1,538,688 | A | 5/1925 | Chicoine | |
| 5,402,589 | A * | 4/1995 | Lubrani et al. | 36/50.1 |
| 5,496,612 | A * | 3/1996 | Ransbottom | 428/99 |
| 5,640,785 | A * | 6/1997 | Egelja | 36/50.1 |
| 6,074,712 | A * | 6/2000 | Ramirez | 428/4 |
| 6,158,096 | A * | 12/2000 | Bar | 24/712.9 |
| 7,328,528 | B2 * | 2/2008 | Caminiti | 36/136 |
| 2005/0066546 | A1 | 3/2005 | Elkington et al. | |
| 2005/0172463 | A1 * | 8/2005 | Rolla | 24/712.1 |
| 2011/0094126 | A1 * | 4/2011 | Walker | 36/136 |

FOREIGN PATENT DOCUMENTS

| | | | |
|---|---|---|---|
| DE | 102004043701 | A1 | 3/2006 |
| EP | 0468532 | A2 | 1/1992 |

* cited by examiner

SHOE, FOR EXAMPLE SHOE WITH A HIGH UPPER

CROSS REFERENCE TO RELATED APPLICATION

This application is a 35 U.S.C. 371 National Phase Entry Application from PCT/EP2009/57611, filed Jun. 18, 2009, which claims the benefit of German Patent Application No. 10 2008 028 882.9 filed on Jun. 18, 2008, the disclosure of which is incorporated herein in its entirety by reference.

The invention relates to a shoe, for example a shoe with a high upper, such as a mountaineering shoe, hiking shoe or the like, comprising an upper with an inlet starting from an upper edge of the upper and extending in the direction of the toe of the shoe, a tongue extending substantially along the inlet, and a tongue retaining unit associated with the tongue, which, when the shoe is done up, at least hinders the tongue from slipping sideways.

With such shoes the problem often arises that the tongue slips sideways after a period of wear, and as a rule towards the outer side of the foot due to the foot's anatomy. In particular with shoes for recreational sport, for instance hiking shoes, mountaineering shoes and the like, in which the foot moves vigorously and often, and rubs correspondingly vigorously against the shoe, painful pressure points or abrasions may result if the tongue is not situated in its "correct" or desired central position relative to the inlet. One cause of the above-mentioned slippage is preshaping of the tongue to match the contour of the foot and optionally the lower leg. If the forefoot bends towards the shin during walking, the tongue is bent to a corresponding degree in the ankle flexure region. The tongue then tries to get out of the way of the lower leg as the latter applies forward pressure and to retain its preshaped position. The consequence is that it moves away to the side. The fact that it usually moves towards the outer side of the foot is related to the anatomical differences between the outer side and inner side of the foot.

To be able to prevent this sideways slippage of the tongue and hold the tongue in the desired position relative to the foot, it is generally known in the prior art to provide a hook- or loop-shaped retaining element on the tongue. When the shoe is done up, this retaining element is fitted or inserted into the fastening device, for example the two ends of a shoelace, so that upwards pulling prevents the tongue from slipping sideways. The known retaining element can only effectively achieve this effect if the tongue is in an ideal position in which it extends corresponding to the instep of an ideal wearer's "standard foot" specified for the particular shoe design.

If the wearer's foot has a low instep, the position of the retaining element moves downwards from this ideal position together with the tongue, whereby the retaining element is loaded in such a way by the shoelaces criss-crossed at this point that ultimately there is a risk of the retaining element tearing away from the tongue. If on the other hand the foot of the wearer of the shoe has a high instep, the retaining element position migrates upwards with the tongue. As a consequence, the crossed-over ends of the shoelace can barely grip the retaining element, such that it loses its effect.

Furthermore, with the known retaining elements the retaining or centring force produced by the crossed-over ends of the shoelace is relatively slight due to the shallow angle of engagement between retaining element and shoelace.

It is therefore the object of the invention to provide a shoe of the above type, in which the tongue retaining device fulfils its function effectively even if the wearer's foot does not correspond to the "standard foot" for said shoe.

This object is achieved according to the invention by a shoe of the above-mentioned type in which a retaining element is associated with each of the two mutually opposing edges of the inlet, which retaining element may be brought into form-fitting retaining engagement with the tongue retaining unit and exerts a pulling force on the tongue retaining unit at least when the latter shifts from a desired position in a direction away from the associated edge when the shoe is done up.

Whereas in the case of prior art shoes the tongue retaining unit can only be brought properly into engagement with the crossed-over ends of the shoelace when the wearer has the "standard foot" for which said shoe was designed, or a foot with a lower instep than the "standard foot", i.e. cannot be brought into engagement with the crossed-over ends of the shoelace when the wearer's foot has too high an instep, the tongue retaining unit according to the invention can be brought into engagement with the two retaining elements irrespective of the particular shape of the foot. Indeed, with prior art shoes the problem arises that engagement of the tongue retaining unit with the shoelace leads to a sort of "downhill force" due to the oblique course taken by the shoelace from the one edge of the inlet to the respective other edge, the magnitude of which force is relatively low due to the relatively shallow gradient of the shoelace. In addition, the value of this force depends on the force, directed in the direction of the longitudinal extent of the inlet, with which the shoelace ends act from below on the retaining element. In contrast, the retaining elements according to the invention may be brought into form-fitting retaining engagement with the tongue retaining unit. This ensures that the pulling force stemming from the retaining elements and directed substantially in the transverse direction of the shoe may be introduced fully into the tongue retaining unit. Through the interaction of the retaining elements associated with the two mutually opposing edges of the inlet, the tongue may thus be held in the desired position irrespective of the particular shape of the wearer's foot.

The at least one retaining element may for example comprise a retaining loop, which extends from the associated edge of the inlet and returns to the associated edge after deflection by the tongue retaining unit. In a particularly simple embodiment, this retaining loop may be formed by a portion of a shoelace serving to do up the shoe. It should be noted that in this context the course taken by the shoelace in the region of the tongue retaining unit differs from the conventional criss-cross pattern, since the shoelace passes from a first hook and eyelet element, which is arranged at an edge in question of the inlet, to the tongue retaining unit and returns to the same inlet edge after deflection by the tongue retaining unit. The shoelace may nonetheless fulfil its doing-up function, since when a pulling force is exerted on the two free ends of the shoelace already deflected by the tongue retaining unit this pulling force is passed on to the respective other edge of the inlet via the tongue retaining unit.

The tongue retaining unit may for example comprise an anchoring element, which is jointly associated with both retaining elements. The anchoring element may be a deflecting element, which is jointly associated with both retaining loops.

In a further development of the invention it is proposed that the tongue retaining unit be separate from the tongue and attached thereto. This also on the one hand simplifies production of the shoe according to the invention and on the other hand ensures that the tongue retaining unit is sufficiently strong, since it may in this case be made from a relatively rigid material, unlike the relatively flexible material of the tongue.

The tongue retaining unit may for example be made as a punched and bent part, preferably from sheet metal.

To be able to increase the stability of the tongue retaining unit on the tongue, the tongue retaining unit may comprise a spacer element, which may preferably be placed onto the tongue by means of a bearing plate, and a hook plate, which is arranged at the end of the spacer element remote from the tongue and projects radially beyond the spacer element at least in two peripheral regions facing the two mutually opposing edges of the inlet. In this respect, the two portions of the hook plate projecting beyond the spacer element form hook elements, which secure the retaining elements to the tongue retaining unit when the shoe is done up.

A further such hook element may be formed in that the hook plate additionally projects radially beyond the spacer element in a peripheral region facing the toe of the shoe, preferably over the entire periphery of the spacer element. For those shoe wearers who cannot get used to this new way of tying shoelaces, this additional hook element may assume the function of a conventional hook element, as is also present on conventional prior art shoes.

The hook elements addressed above may for example all be formed in that the hook plate projects beyond the spacer element over substantially its entire periphery, wherein said hook plate comprises at least one portion which extends radially to a greater extent and at least one portion which extends radially to a lesser extent beyond the spacer element. The greatest radial extent does not then necessarily have to be present in the peripheral regions facing the two mutually opposing edges of the inlet or the peripheral region facing the toe of the shoe. Taking account of the course taken by the retaining elements, for example the shoelaces, it may instead be advantageous for the radial extent of the hook plate projecting beyond the spacer element to be at its greatest in at least one peripheral portion, preferably those four peripheral portions, which forms/form an angle of between approx. 30° and approx. 60°, preferably approx. 45°, with the longitudinal axis of the tongue. In this respect, it should also not be ruled out according to the invention that at least two of the peripheral portions of the greatest radial extent are joined together, provided that the joined-together peripheral portion comprises only two sub-portions, which form an angle of between approx. 30° and approx. 60°, preferably approx. 45°, with the longitudinal axis of the tongue and provided that the entire periphery of the hook plate comprises at least one portion which extends radially to a greater extent and at least one portion which extends radially to a lesser extent beyond the spacer element.

To ensure a secure hold for the retaining elements, for example for the shoelaces, it is advantageous for the radial extent of the hook plate projecting beyond the spacer element to amount in the at least one portion of greatest radial extent to between approx. 4 mm and approx. 7 mm, preferably approx. 5.5 mm.

Furthermore, a development of the invention proposes that the hook plate be curved away from the tongue at least in places at its peripheral edge and/or that the bearing plate have a curvature conformed to the shape of the tongue. In this way, a guide bevel simplifying insertion of the retaining elements, for example the shoelaces, may be provided.

To be able to ensure a good hold for the retaining elements, for example for the shoelaces, the length of the spacer element may amount to between approx. 2.5 mm and approx. 3.5 mm, preferably approx. 3.0 mm. These dimensions are based on the fact that, when unstretched, the shoelaces conventionally used have a diameter of approx. 4 mm and, when stretched, have a diameter of approx. 3 mm. It should here be noted that the values indicated for the "shoelace diameters" relate to effective diameters, i.e. diameters of a disc which has the same cross-sectional area as the shoelace.

Furthermore, the tongue retaining unit may be fixed to the tongue by means of a single fixing element, for example by means of a single rivet.

Irrespective of the mode of fixing the tongue retaining unit to the tongue, the spacer element may be of tubular construction, the single fixing element advantageously passing through the central cavity of the tube, however.

If the tubular spacer element is passed through by a fixing element, preferably by the single fixing element, this fixing element serves at the same time to fix the tongue retaining unit to the tongue and to deflect the two retaining elements, in particular shoelace loops.

From a further standpoint, the invention relates to the novel lacing, already explained above, of a shoe, for example of a shoe with a high upper, such as a mountaineering shoe, hiking shoe or the like, in which a retaining loop formed by a portion of the shoelace extends from each of the two mutually opposing edges of the inlet, and after deflection by the tongue retaining unit, with form-fitting engagement with the tongue retaining unit, returns to the same edge. With regard to the advantages achievable with this novel lacing, reference is made to the above discussion of the shoe according to the invention.

The retaining loop formed by the shoelace may here extend from a first hook and eyelet element arranged at the respective edge of the inlet and, after deflection by the tongue retaining unit, return to a second hook and eyelet element arranged at the respective edge of the inlet, which second hook and eyelet element is adjacent the first hook and eyelet element. Depending on whether the wearer of the shoe has a foot with a high, standard or low instep, a pair of hook and eyelet elements arranged higher or lower on the upper may be used as the first and second hook and eyelet elements in the context of the novel lacing.

The invention is explained in greater detail below with reference to the appended drawings and by means of a number of exemplary embodiments. In the Figures, FIG. 1 is a perspective view of a shoe according to the invention laced in the manner according to the invention;

Figure 1:
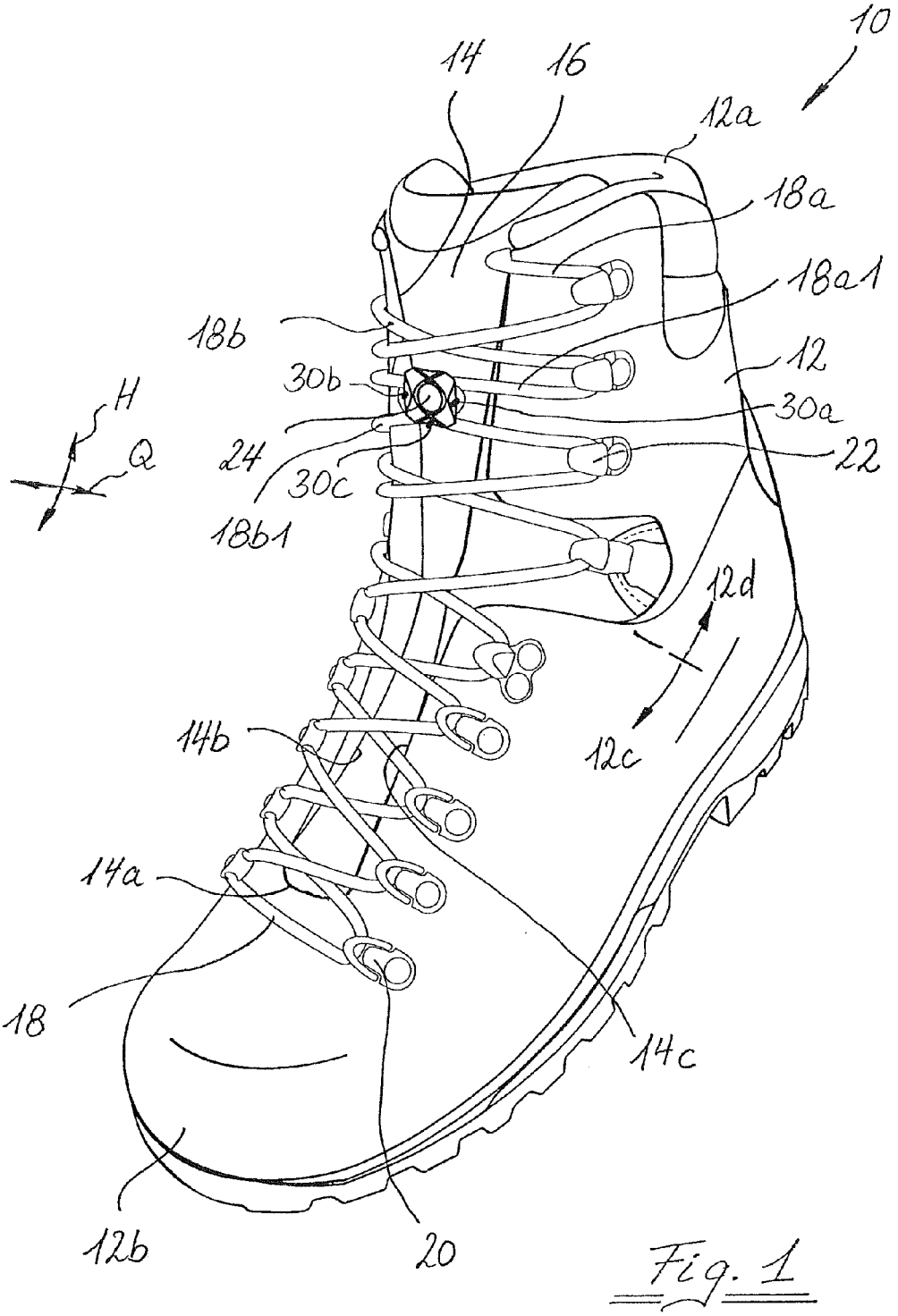

In FIG. 1 a shoe according to the invention is designated overall as 10. The shoe 10 comprises a high upper 12, i.e. an upper which reaches to above the wearer's ankle. An inlet 14 starts at an upper edge 12*a* of the upper and extends in the direction of the toe 12*b* of the shoe. The inlet 14 is covered on the inside of the upper 12 by a tongue 16, which is conventionally joined to the upper 12 in the region of the lower inlet end 14*a*, for example is stitched thereto. The shoe 10 is done up by a shoelace 18, which in the forefoot/instep region 12*c* of the upper 12 is passed through eyelet elements 20 on a criss-cross path, which eyelet elements are fixed to the upper 12 along the edges 14*b* and 14*c* of the inlet 14. In addition, hook elements 22 adjacent the inlet edges 14*b* and 14*c* are provided in the lower leg region 12*d* of the upper 12. Finally, a tongue retaining unit 24 is fixed to the tongue 16 substantially at the level of the hook elements 22.

Figure 3:
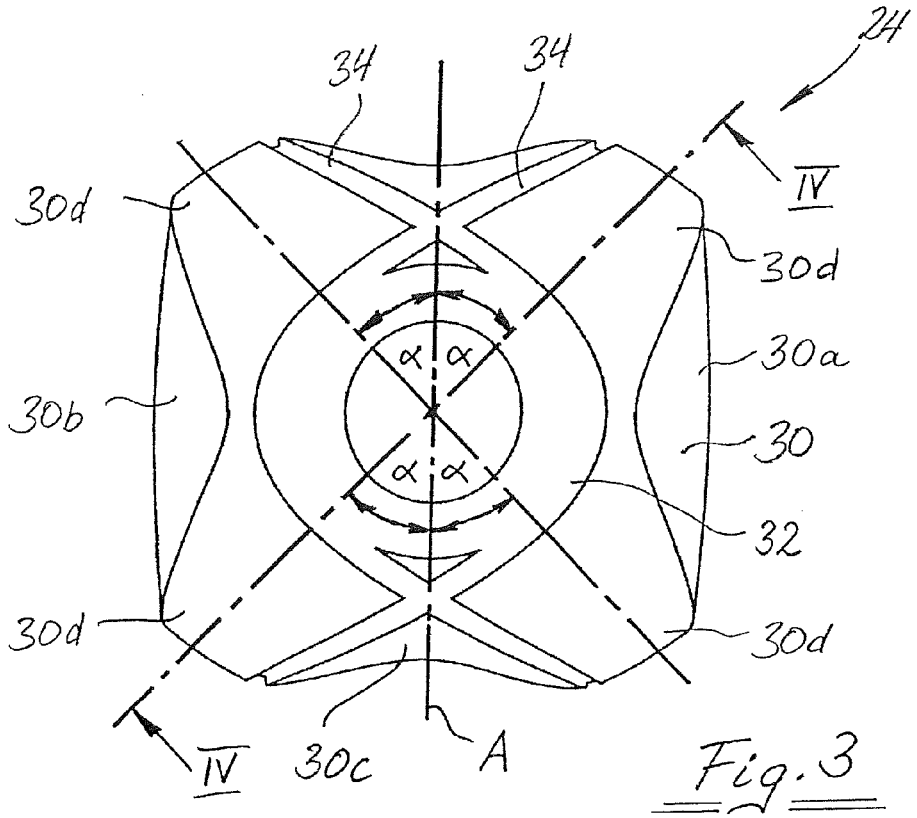
FIG. 3 is a plan view of the tongue retaining unit according to the invention.
Figure 4:
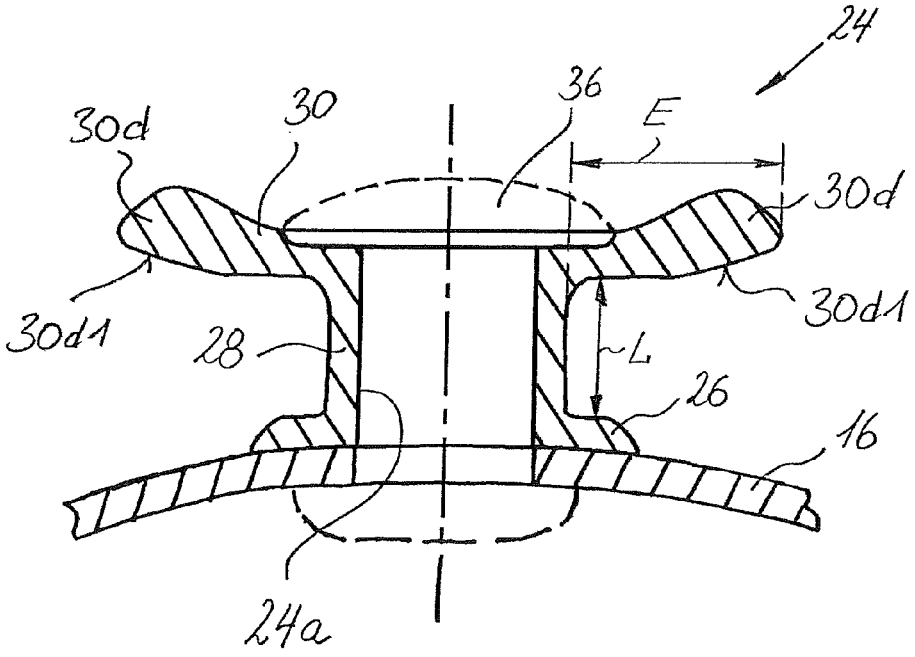
FIG. 4 shows a section along line IV-IV in FIG. 3.

As is also clear from FIGS. 3 and 4, the tongue retaining unit 24 comprises a bearing plate 26, with which it rests on the surface of the tongue 16. The bearing plate 26 is adjoined in one piece by a spacer element 28 of tubular construction, at whose end remote from the bearing plate 26 there is in turn formed a hook plate 30. In addition, a through-hole 24*a* is formed in the tongue retaining unit 24, which serves for passage of a fixing element 36, by means of which the tongue retaining unit 24 may be fixed to the tongue 16. The fixing element 28 may take the form, for example, of a fixing rivet.

In the embodiment illustrated, the hook plate 30 projects beyond the spacer element 28 over its entire periphery and thus forms hook elements both in the portions 30*a* and 30*b* facing the two edges 14*b*, 14*c* of the inlet 14 and in the portion 30*c* facing the toe 12*b* of the shoe, which hook elements serve to hold the shoelace 18 securely on the tongue retaining unit 24.

According to a new manner of lacing the shoelace 18 of the shoe 10 illustrated in FIG. 1, a shoelace loop 18*a*1 extends from a first hook element 22 in the region of the inlet edge 14*c* at the level of the tongue retaining unit 24, is deflected by the spacer element 28 of the tongue retaining unit 24 and returns to a further hook element 22 in the region of the same inlet edge 14*c*. Likewise, a shoelace loop 18*b*1 additionally extends from a first hook element 22 in the region of the inlet edge 14*b* at the level of the tongue retaining unit 24, is deflected by the spacer element 28 of the tongue retaining unit 24 and returns to a further hook element 22 in the region of the same inlet edge 14*b*. The spacer element 28 thus forms an anchoring element for the loops 18*a*1 and 18*b*1.

According to the above, the tongue retaining unit 24 is held by the two loops 18*a*1 and 18*b*1 in the position established for it in transverse direction Q during lacing of the shoelace 18, irrespective of the position of the tongue retaining unit 24 in vertical direction H established by the height of the instep of the wearer of the shoe 12. In this respect, adaptation to the vertical position of the tongue retaining unit 24 is likewise brought about simply by loops 18*a*1 and 18*b*1.

As is clear from FIG. 1, the two loops 18*a*1 and 18*b*1 cross over under the hook plate 30. The length of the spacer element 28 is therefore such that the two loops 18*a*1 and 18*b*1 reliably have enough space under the hook plate 30. In addition, a marking 32 is provided on the top of the hook plate 30, in the exemplary embodiment illustrated in FIG. 3 in the form of intersecting grooves 34, which graphically represent the course of the crossed-over loops 18*a*1 and 18*b*1, to draw the attention of the wearer of the shoe 10 to the novel mode of lacing.

Furthermore, the hook plate 30 extends radially furthest beyond the spacer element 28 adjacent to those points at which the loops 18*a*1 and 18*b*1 emerge from under the hook plate 30. These projections 30*d* are situated in peripheral portions of the hook plate 30 which form an angle $\alpha$ of between approx. 30° and approx. 60°, preferably approx. 45°, with the longitudinal axis A of the tongue. Through the interaction of these projections 30*d* the loops 18*a*1 and 18*b*1 are held securely under the hook plate 30. In addition, as illustrated in FIG. 4 guide bevels 30*d*1 on the bottom of the projections 30*d* simplify insertion of the loops 18*a*1 and 18*b*1 under the hook plate 30.

Figure 2:
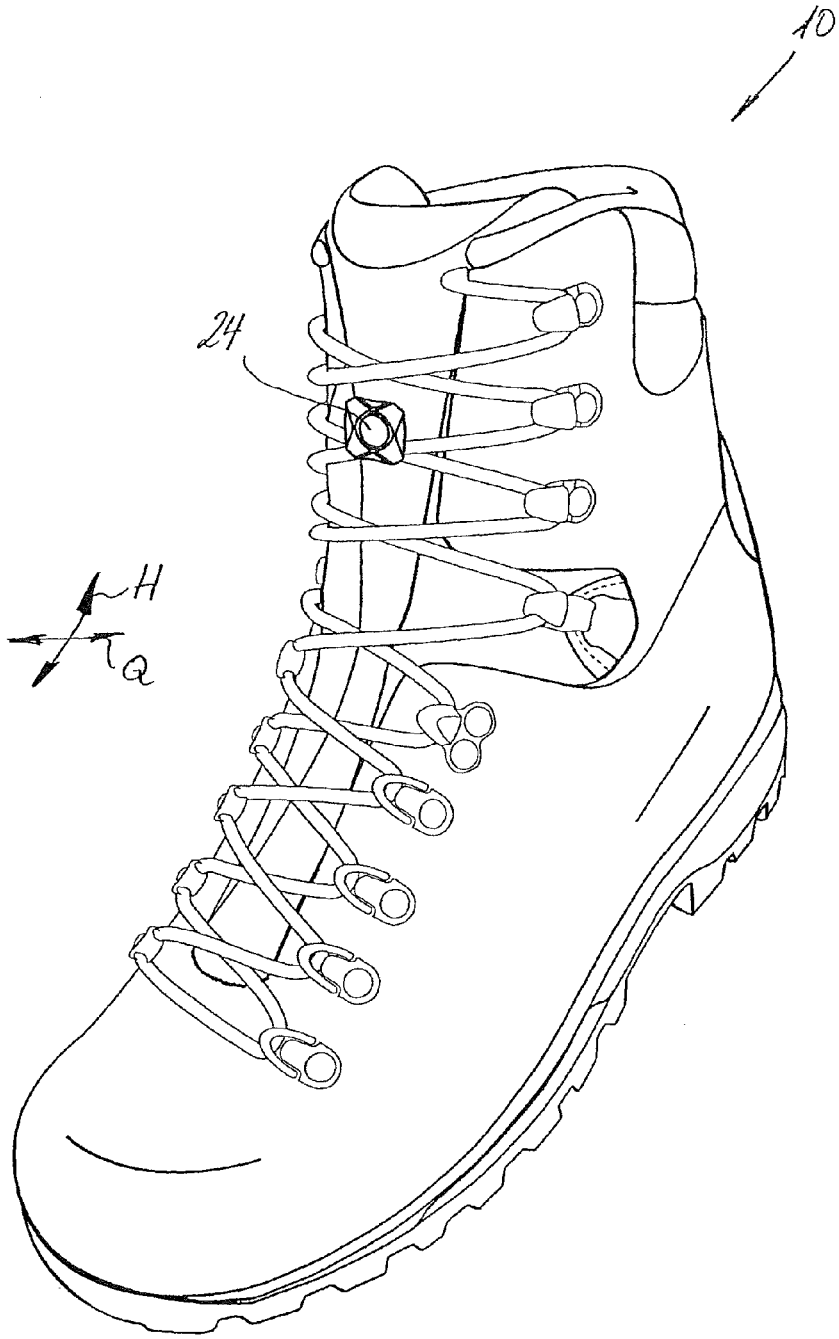
FIG. 2 is a perspective view of a shoe according to the invention, laced in the conventional manner.

If a wearer of the shoe 10 according to the invention cannot get used to the arrangement and course of the shoelace 18 illustrated in FIG. 1, the fact that the tongue retaining unit 24 also comprises a hook element on its side facing the toe 12*b* of the shoe in the region 30*c* of the hook plate 30 makes it possible for the shoelace 18 also to be tied in the conventional purely criss-crossed manner, as illustrated in FIG. 2. In this case the tongue retaining unit 24 is used in the same way as is known from conventional high-upper shoes with tongue retaining units, i.e. in this case the two portions 18*a*, 18*b* of the shoelace 18 coming from the two mutually opposing edges 14*b* and 14*c* would cross over below the spacer element 28 and then carry on to the respective other one of the inlet edges 14*c* and 14*b*. In this case the two lower projections 30*d* ensure that the shoelace 18 is held securely on the tongue retaining unit 24.

It should be added that, to ensure a secure hold for the retaining loops 18*a*1, 18*b*1, it is advantageous for the value of the radial extent E of the hook plate 30 projecting beyond the spacer element 28 to amount in the at least one portion 30*d* of greatest radial extent to between approx. 4 mm and approx. 7 mm, preferably approx 5.5 mm.

It should additionally be added that the length L of the spacer element 28 between the top of the bearing plate 26 and the bottom of the hook plate 30 may amount to between approx. 2.5 mm and approx. 3.5 mm, preferably approx. 3.0 mm.

The invention claimed is:

1. A shoe comprising:

an upper portion with an inlet starting from an upper edge of the upper portion and extending in the direction of a toe of the shoe, wherein the inlet comprises two mutually opposing edges;

a tongue extending substantially along the inlet; and a tongue retaining unit attached to the tongue, which, when the shoe is laced, at least hinders the tongue from slipping sideways, wherein at least one retaining element is associated with at least one of the mutually opposing edges of the inlet, and wherein the at least one retaining element is capable of being brought into form-fitting retaining engagement with the tongue retaining unit such that the at least one retaining element exerts a pulling force on the tongue retaining unit at least when the tongue retaining unit shifts from a desired position in a direction away from the associated edge when the shoe is laced, and wherein the tongue retaining unit comprises a spacer element placed onto the tongue by a bearing plate, and a hook plate arranged at the end of the spacer element remote from the tongue, wherein the bearing plate, the spacer element, and the hook plate are a single unitary piece, and wherein the hook plate projects radially beyond the spacer element and the bearing plate at least in two peripheral regions facing the two mutually opposing edges of the inlet, and wherein the hook plate is contactable by at least one of the at least one retaining element.

2. A shoe according to claim 1, wherein at least one of the at least one retaining element comprises a retaining loop, which extends from the associated edge of the inlet and, after deflection by the tongue retaining unit, returns to the associated edge.

3. A shoe according to claim 2, wherein the retaining loop is formed by a portion of a shoelace serving to lace the shoe.

4. A shoe according to claim 1, wherein the tongue retaining unit comprises an anchoring element, which is jointly associated with at least one of the at least one retaining element.

5. A shoe according to claim 1, wherein the tongue retaining unit is separate from the tongue.

6. A shoe according to claim 5, wherein the tongue retaining unit is fixed to the tongue by a single fixing element.

7. A shoe according to claim 5, wherein the spacer element is of tubular construction.

8. A shoe according to claim 5, wherein a value (E) of the radial extent of the hook plate projecting beyond the spacer element is between 4 mm and 7 mm in the at least one peripheral portion of greatest radial extent.

9. A shoe according to claim 5, wherein a value (E) of the radial extent of the hook plate projecting beyond the spacer element is approximately 5.5 mm in the at least one peripheral portion of greatest radial extent.

10. A shoe according to claim 1, wherein the hook plate additionally projects radially beyond the spacer element in a peripheral region facing the toe of the shoe.

11. A shoe according to claim 10, wherein the hook plate projects radially beyond the spacer element over the entire periphery of the spacer element.

12. A shoe according to claim 1, wherein a radial extent of the hook plate, projecting beyond the spacer element, is greatest in at least one peripheral portion, which forms an angle (a) of between 30° and 60°, with a longitudinal axis (A) of the tongue.

13. A shoe according to claim 1, wherein the hook plate is curved away from the tongue at least at the peripheral edge of the hook plate.

14. A shoe according to claim 1, wherein a length (L) of the spacer element is between 2.5 mm and 3.5 mm.

15. The shoe according to claim 1, wherein the shoe is a mountaineering shoe or a hiking shoe.

16. A shoe according to claim 1, wherein a radial extent of the hook plate, projecting beyond the spacer element, is greatest in at least one peripheral portion, which forms an angle (a) of approximately 45°, with a longitudinal axis (A) of the tongue.

17. A shoe according to claim 1, wherein the bearing plate has a curvature conformed to the shape of the tongue.

18. A shoe according to claim 1, wherein the bearing plate has a non-zero curvature conformed to the shape of the tongue.

19. A shoe according to claim 1, wherein a length (L) of the spacer element is approximately 3.0 mm.

20. A lacing of a shoe and a shoe including said lacing, wherein the shoe comprises an upper portion with an inlet starting from an upper edge of the upper portion and extending in the direction of a toe of the shoe, wherein the inlet comprises two mutually opposing edges;

a tongue extending substantially along the inlet;

a tongue retaining unit attached to the tongue, which, when the shoe is laced, at least hinders the tongue from slipping sideways, wherein the tongue retaining unit comprises a spacer element placed onto the tongue by a bearing plate, and a hook plate arranged at the end of the spacer element remote from the tongue, wherein the bearing plate, the spacer element, and the hook plate are a single unitary piece, and wherein the hook plate projects radially beyond the spacer element and the bearing plate at least in two peripheral regions facing the two mutually opposing edges of the inlet, and wherein the hook plate is contactable by at least one retaining element comprising a portion of a shoelace; and the shoelace serving to lace the shoe, wherein at least one retaining loop formed by a portion of the shoelace extends from at least one of the mutually opposing edges of the inlet, and after deflection by the tongue retaining unit, with form-fitting engagement with the tongue retaining unit, returns to the same edge.

21. The lacing according to claim 20, wherein the at least one retaining loop extends from a first hook and eyelet element arranged at the associated edge of the inlet and, after deflection by the tongue retaining unit, returns to a second hook and eyelet element arranged at the same edge of the inlet, wherein the second hook and eyelet element is adjacent to the first hook and eyelet element.

* * * * *